US008123095B2

(12) United States Patent
Dittrich

(10) Patent No.: US 8,123,095 B2
(45) Date of Patent: Feb. 28, 2012

(54) CORNBUSTION-OPERATED SETTING TOOL

(75) Inventor: Tilo Dittrich, Grabs (CH)

(73) Assignee: Hilti Aktiengesellschaft, Schaan (LI)

( * ) Notice: Subject to any disclaimer, the term of this patent is extended or adjusted under 35 U.S.C. 154(b) by 182 days.

(21) Appl. No.: 12/218,177

(22) Filed: Jul. 10, 2008

(65) Prior Publication Data

US 2009/0014494 A1 Jan. 15, 2009

(30) Foreign Application Priority Data

Jul. 11, 2007 (DE) ..... 10 2007 000 373

(51) Int. Cl.
*B25C 1/08* (2006.01)

(52) U.S. Cl. ..... 227/10; 227/2

(58) Field of Classification Search ..... 227/10, 227/2, 4; 123/46 SC, 46 R
See application file for complete search history.

(56) References Cited

U.S. PATENT DOCUMENTS

| | | | | |
|---|---|---|---|---|
| 6,006,168 | A * | 12/1999 | Schumann et al. | 702/132 |
| 7,040,261 | B2 * | 5/2006 | Granacher et al. | 123/46 SC |
| 2004/0011304 | A1 * | 1/2004 | Herynek et al. | 123/41.1 |
| 2005/0173485 | A1 * | 8/2005 | Moeller et al. | 227/10 |

* cited by examiner

*Primary Examiner* — Lindsay Low
*Assistant Examiner* — Nathaniel Chukwurah
(74) *Attorney, Agent, or Firm* — Abelman, Frayne & Schwab

(57) ABSTRACT

A combustion-operated setting tool (10) for driving in fastening elements, includes a combustion drive for driving a setting piston (13) displaceable in a guide cylinder (12) and which drive has at least one combustion chamber (14), a ventilator (16) for the combustion drive, a control unit (30) for controlling the ventilator (16) dependent on a thermal control parameter and having a program for modeling the thermal control parameter based on time data and ventilator operation data.

6 Claims, 2 Drawing Sheets

CORNBUSTION-OPERATED SETTING TOOL

BACKGROUND OF THE INVENTION

1. Field of the Invention

The present invention relates to a combustion-operated setting tool for driving in fastening elements and including a combustion drive for driving a setting piston displaceable in a guide cylinder, a ventilator for the combustion drive, and a control unit for controlling the ventilator.

2. Description of the Prior Art

Setting tools of this kind can be operated, e.g., with gaseous or vaporizable liquid fuels. In combustion-operated setting tools, a setting piston is driven by combustion gases during a setting process. Fastening elements can then be driven into a substrate by the setting piston. In the setting tools of this type, ventilator functions include cooling the setting tool that has been heated by the occurring combustion processes. The cooling is necessary because it is important for the thermal return of the piston, for example, that the combustion chamber wall does not become too hot. Further, excessive heating of the metering valve can lead to faulty metering of the fuel when the setting tool becomes too hot.

US 2005/0173485 A1 discloses a combustion-operated setting tool having a combustion-operated energy source and a ventilator associated with the latter. A control device which is connected to a temperature sensor monitoring the temperature of the energy source is provided for adjusting the operating time. The duration of the operating time of the ventilator can be adjusted by the control device as a function of the temperature of the energy source detected by the temperature sensor.

The disadvantage of providing a temperature sensor consists in a complicated design of the sensor and increased production cost. The temperature sensor must be connected to the control device located in the handle assembly. As the temperature sensor is arranged in the vicinity of the energy source, in particular in the vicinity of the cylinder for the driving piston, long cable paths are required. This makes the combustion-operated setting tool expensive to manufacture.

SUMMARY OF THE INVENTION

An object of the present invention is a setting tool of the type mentioned above and having a temperature-controlled cooling of the drive by a ventilator at lower cost.

This and other objects of the present invention, which will become apparent hereinafter, are achieved by providing a control unit having a program for modeling the thermal control parameter based on time data and ventilator operation data. As a result of this step, a temperature sensor which is prone to malfunction is no longer needed in the vicinity of the combustion chamber, and the complicated wiring to the control unit that is usually arranged in the handle area, can be dispensed with. In an advantageous manner, heat supply constants and heat discharge constants could also be used additionally for modeling the thermal control parameter. In this way, when modeling the thermal control parameter, the heat or temperature of the other structural component parts of the combustion drive, e.g., the setting piston, could also be taken into account in addition to the temperature or quantity of heat present, e.g., in the guide cylinder based on suitable determination and preadjustment of the heat discharge constants.

A time measurement device is advantageously provided for determining a current time so that the time intervals between two setting processes can be accurately determined and so that, for example, it is possible to calculate with greater accuracy the quantity of heat discharged into the environment between two setting processes.

In an advantageous manner, an ambient temperature, which is determined by a temperature sensor, can also be used by the program running in the control unit for modeling the thermal control parameter so that, e.g., it is likewise possible to more accurately calculate the quantity of heat discharged into the environment between two setting processes. Further, a temperature sensor for measuring the ambient temperature has a longer lifetime than a temperature sensor arranged at the combustion space because it is not exposed to such high temperatures. Further, the temperature sensor for the ambient temperature can be arranged directly on a printed circuit board so as to save costs.

Further, it is advantageous when the control unit cooperates with a data storage, particularly a nonvolatile data storage, in which the modeled thermal control parameter can be stored as a modeled thermal control parameter of a preceding setting process, a current time can be stored as a timestamp, and in which the ventilator operating data can also be stored. This step also makes it possible to effect accurate modeling of the thermal control parameter when switching on again after a longer interruption in operation of the setting tool when the data processing unit has been without electric current in the intervening time period.

In an advantageous manner, an after-running time of the ventilator can be adjusted by the control unit dependent on the modeled thermal control parameter and on a lower threshold value and upper threshold value stored in the data storage so as to enable an exact control of the ventilator for cooling the combustion drive.

A method for a combustion-operated setting tool advantageously includes the following steps:

- a setting process is triggered after a trigger switch signal has been detected;
- the modeled thermal control parameter of a preceding setting process, the timestamp, and the ventilator operating data are read out from the data storage;
- the thermal control parameter is modeled based at least on the thermal control parameter of the preceding setting process, the timestamp, the current time, the ventilator operating data, and based on the heat supply constant and heat discharge constant, and
- the modeled thermal control parameter of the combustion drive is stored in the data storage as a modeled thermal control parameter of a preceding setting process, the current time is stored in the data storage as a timestamp, and the ventilator operating data are stored in the data storage.

Further, a method of the type described above is advantageous when an ambient temperature determined by a temperature sensor is also used for a more accurate determination of the cooling that has taken place up to a predetermined point in time, and of the amount of heat discharged to the environment for modeling the thermal control parameter.

It is also advantageous when the after-running time of the ventilator is adjusted by the control unit, after the modeling of the thermal control parameter, dependent on the modeled thermal control parameter of the combustion drive and on a lower threshold value and upper threshold value which are stored in the data storage. Thereby a power-saving use of the ventilator can be carried out in which the ventilator is only put into operation when the temperature of the combustion drive makes it necessary. This power-saving usage makes it possible to set more fastenings per battery charge.

Alternatively, it is advantageous when the rotational speed of the ventilator is adjusted by the control unit after modeling the thermal control parameter dependent on the modeled thermal control parameter of the combustion drive and on a lower threshold value and upper threshold value which are stored in the data storage. In this way, a power-saving use of the ventilator can be carried out in which the ventilator is only put into operation when the temperature of the combustion drive makes it necessary. More settings per battery charge can be achieved by means of this power-saving usage.

Also alternatively, it is advantageous when the rotational speed and the after-running time of the ventilator are adjusted by the control unit after the modeling of the thermal control parameter dependent on the modeled thermal control parameter of the combustion drive and on a lower threshold value and upper threshold value which are stored in the data storage. In this way, a power-saving usage of the ventilator can be carried out in which the ventilator is only put into operation when the temperature of the combustion drive makes it necessary. More settings per battery charge can be achieved by means of this power-saving usage.

The adjustment of a ventilator after-running time by the control unit is advantageously first carried out after switching off the signal of a switching means, that is, when it is clear that the setting tool has been lifted off a workpiece.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
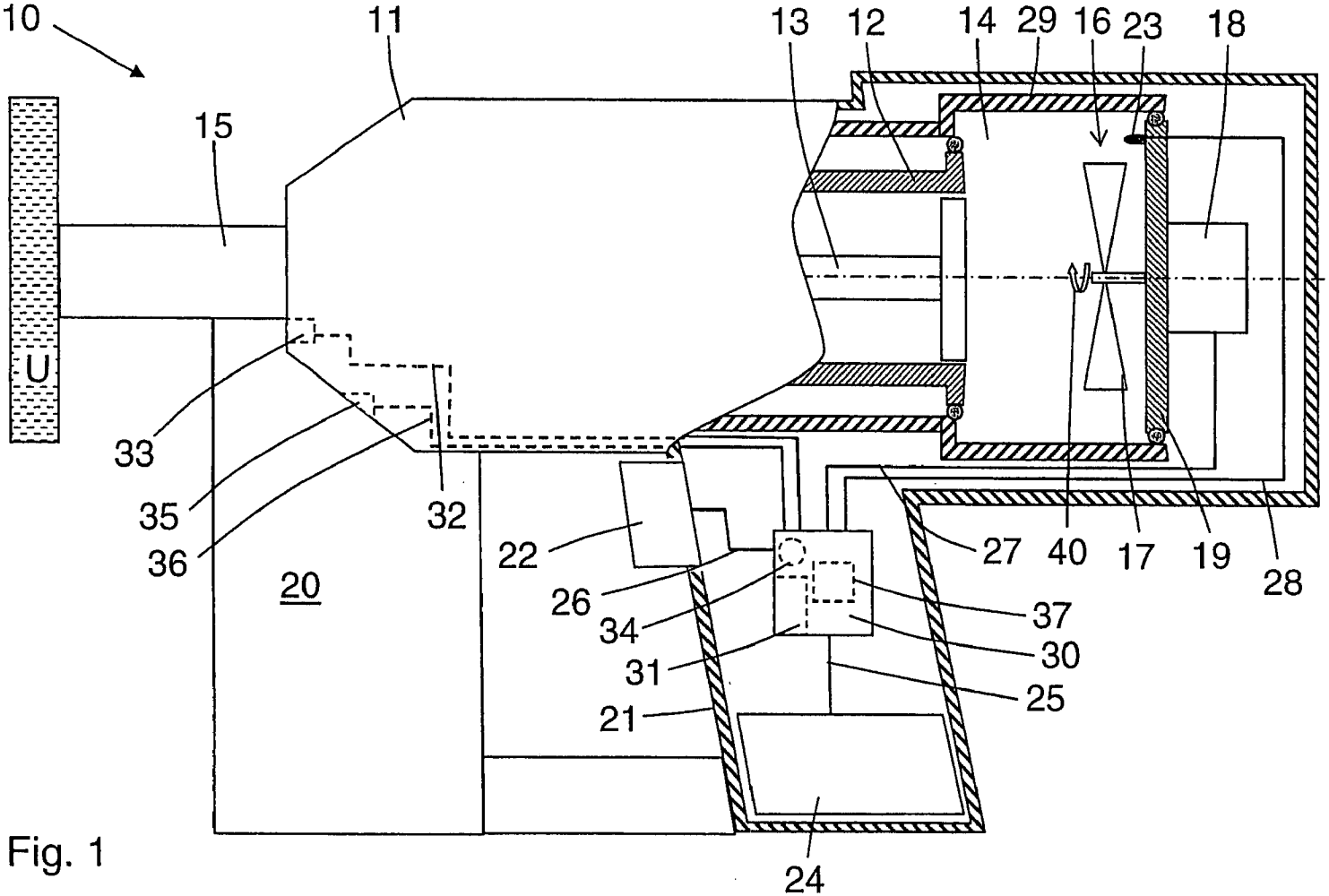
FIG. 1 a side longitudinal, partially cross-sectional view of a setting tool according to the present invention.

The setting tool 10 shown in FIG. 1 has a housing formed of one or more parts, designated in its entirety by a reference numeral 11, a guide cylinder 12, and a combustion drive for a setting piston 13 which is displaceably guided in the guide cylinder 12. A fastening element such as a nail, bolt, etc. can be driven into a workpiece U by the setting piston 13 when the setting tool 10 is pressed against the workpiece U by a bolt guide 15 adjoining the guide cylinder 12 in an operational direction of the setting piston 13, and the combustion drive is actuated. The combustion drive includes a combustion chamber 14 which expands in a combustion chamber sleeve 29 and which is defined at its two axial ends by the guide cylinder 12 and the setting piston 13, on one side, and by a combustion chamber rear wall 19, on the other side. The combustion chamber 14 is already closed in FIG. 1 because the setting tool 10 has been pressed against a workpiece U. The bolt guide 15 serves to receive and guide fastening elements which are stored, e.g., in a magazine 20 at the setting tool 10.

As can also be seen from FIG. 1, a trigger switch 22 is arranged at a handle 21 of the setting tool 10. A firing device 23 (arranged, for example, at the combustion chamber rear wall 19) such as a spark plug, can be triggered by the trigger switch 22 when the setting tool 10 has been pressed against a workpiece U.

In the present embodiment, the setting tool 10 can be operated by a combustible gas or by a vaporizable liquid fuel which is provided in a fuel reservoir, not shown in the drawings, e.g., a fuel can, fuel tank, or the like. A fuel line (not shown in the drawings) leads from the fuel reservoir to the combustion chamber 14.

A ventilator, designated in its entirety by 16, serves to generate a turbulent flow regime of an oxidant fuel mixture filling the closed combustion chamber 14 and also to flush the opened combustion chamber 14 with fresh air and to cool the combustion chamber 14 after the setting process has been carried out. The ventilator 16 has a ventilator wheel 17 which is constructed as a propeller and which is arranged on a rotor shaft of a ventilator motor 18 and rotates in the rotational direction shown by arrow 40 during operation.

The electric consumer, e.g., the firing device 23 or the ventilator motor 18 of the setting tool 10 is supplied with electrical power by a network voltage-independent electric energy source 24 in the form of at least one battery. The battery or batteries can be replaceably arranged in the setting tool 10.

The control of the ventilator 16 and of other device functions is carried out by a control unit 30 having a digital data processing unit 37 such as one or more microprocessors. In the embodiment shown in the drawing, the control unit 30 has a nonvolatile data storage 31 for storing data in digital form and a time measuring device 34 for determining a current time t_new. The control unit 30 is connected by a first electric lead 25 to the energy source 24. Further, the control unit 30 is connected to the trigger switch 22 by a second electric lead 26 and to the ventilator motor 18 by a third electric lead 27. The firing device 23 is connected to the control unit 30 by a fourth electric lead 28.

Further, switching means 33, which is formed as a press-on switch, is arranged at the setting tool 10, and is connected by a fifth electric lead 32 to the control unit 30. The switching means 33 detects when the bolt guide 15 is pressed against a workpiece U, whereupon it generates a switch signal. A temperature sensor 35 which is arranged on the outer side of the setting tool determines the ambient temperature T_U and is connected by a sixth electric lead 36 to the control unit 30. The temperature sensor can be economically arranged directly on the main circuit board of the control unit. To this end, the main circuit board need merely be at a sufficient distance from the tool parts which become hot during operation.

Figure 2:
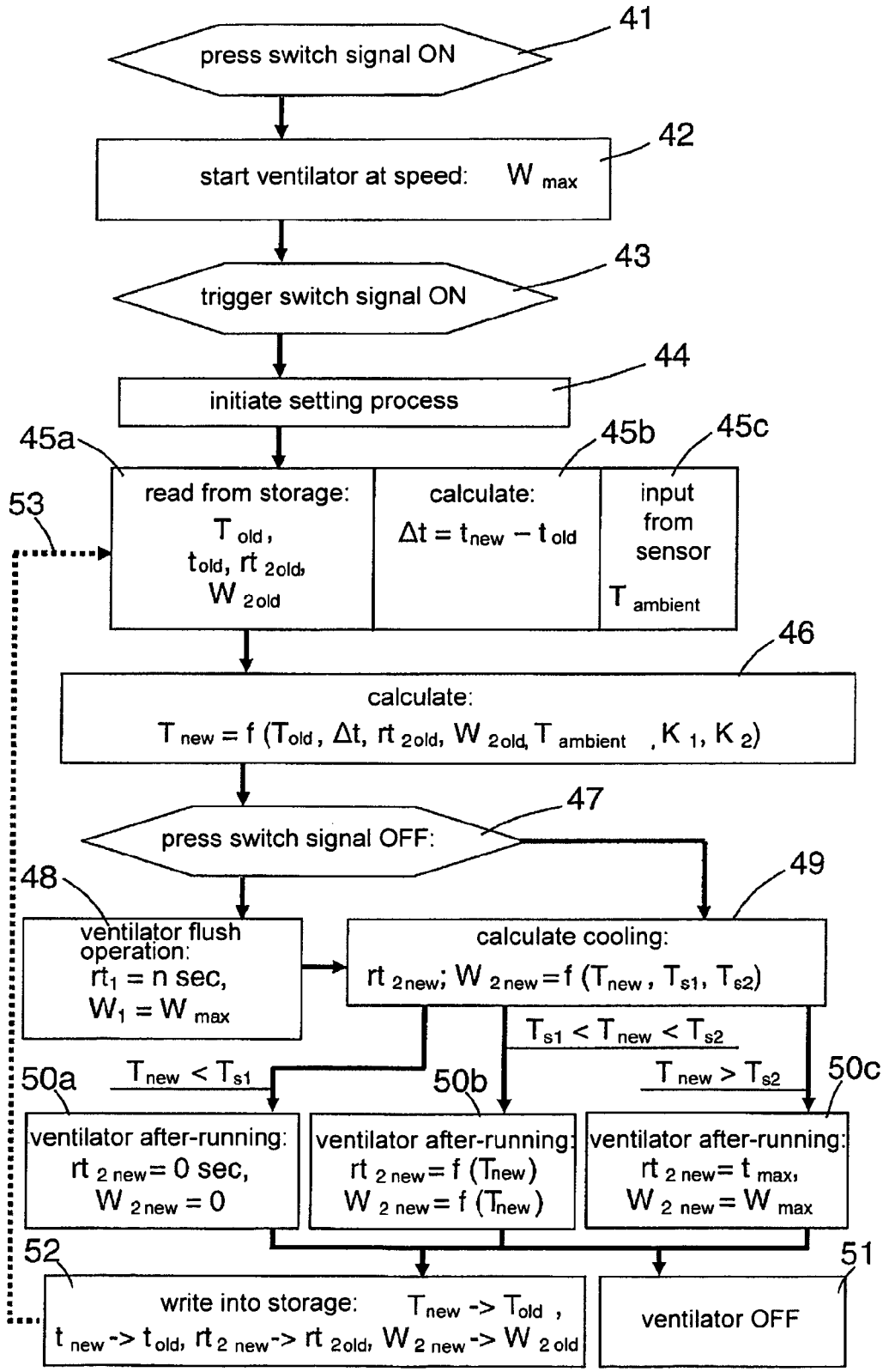
FIG. 2 a flowchart for controlling the ventilation motor of the setting tool.

FIG. 2 shows a flowchart illustrating a method which runs in the control unit 30, more precisely in its data processing unit 37, for controlling the ventilator 16 and its motor 18. The method comprises a data processing program for modeling a thermal control parameter T_new.

After the switching means 33 detects that the setting tool 10 is pressed against a workpiece U, a press-on switch signal 41 is communicated to the control unit 30, the ventilator is put into operation 42 by the control unit 30 at a ventilator speed W max corresponding to the maximum possible speed of the ventilator motor 18. When the trigger switch 22 is actuated, a trigger switch signal is communicated to (43) the control unit 30. The control unit 30 then initiates (44) a setting process, actuating the firing device 23 (see FIG. 1) via the fourth electric lead 28. The following data are preferably read out (45*a*) from the data storage 31 after the setting process is initiated: a modeled thermal control parameter of a preceding setting process T_old, a timestamp t_old of a preceding setting process, and ventilator operating data including a ventilator after-running time rt_2_old of a preceding setting process, and a ventilator speed W_2_old of the ventilator 16 during the ventilator after-running period rt_2_old. The thermal control parameter can be, e.g., a temperature in degrees Centigrade, degrees Fahrenheit or Kelvin, or an amount of heat in kJ.

After a delay or simultaneously with the reading of the data, the time period delta_t that has passed between a current time t_new and the time characterized by the timestamp t_old is calculated (45*b*) by the formula: delta_t=t_new−t_old. The ambient temperature T_U is interrogated (45*c*) and detected by the temperature sensor 35, also after a delay or simultaneously.

In a next step (46), a current thermal control parameter T_new is modeled and calculated [T_new=f (T_old, delta_t, rt_2_old, W_2_old, T_U, K_1, K_2)] from the data acquired by the control unit 30 (modeled thermal control parameter of a preceding setting process T_old, timestamp t_old of a preceding setting process, ventilator after-running time rt_2_old of a preceding setting process, ventilator speed W_2_old of the ventilator 16 during the ventilator after-running period rt_2_old) and on the basis of a heat discharge constant K_1 and a heat supply constant K_2. The heat discharge constant K_1 is the heat exchange of the setting tool 10 or its combustion drive (with the guide cylinder and the setting piston) with the environment and the cooling effect produced by the flushing operation of the ventilator 16 and by the running (42) of the ventilator for generating turbulence after the setting tool 10 is pressed against the workpiece U. In contrast, the heat supply constant K_2 is the increase in heat or temperature of the setting tool 10 caused by a setting process.

When the setting tool 10 is lifted from the workpiece U after completion of a setting process, the switching means 33 is switched off. After the "press-on switch signal OFF" is detected, the control unit 30 switches to a flushing operation (48) of the ventilator 16 in which the ventilator 16 is operated for a ventilator flushing operation period rt_1 of n seconds at a ventilator speed W_1 corresponding to the maximum ventilator speed W_max, where n is a constant (e.g., 2 seconds).

After a delay or simultaneously with the initiation of the flush operation (48) of the ventilator 16, the necessary cooling of the setting tool 10 and its combustion drive by a ventilator 16 is determined (49) by the control unit 30. For this purpose, the modeled thermal control parameter T_new is compared in the control unit 30 with a controlled lower threshold T_s1 and with a controlled upper threshold T_s2.

Like the thermal control parameter (T_new, T_old), the threshold values T_s1 and T_s2 can likewise be defined as a temperature in degrees Centigrade, degrees Fahrenheit or Kelvin or as a quantity of heat in kJ. If the modeled thermal control parameter T_new is less than the lower threshold value T_s1, then the ventilator 16 is not put into operation or not kept in operation (50*a*) by the control unit 30. After-running is not necessary (ventilator running time rt_2_new=0 seconds, ventilator speed W_2_new=0) and the ventilator 16 is directly switched off (51) by the control unit 30. If the modeled thermal control parameter T_new lies between the lower threshold value T_s1 and the upper threshold value T_s2, the ventilator 16 is set in after-running (50*b*) by the control unit 30 with a ventilator after-running time rt_2_new and at a ventilator speed W_2_new which depend on the quantity of the modeled thermal control parameter T_new. The ventilator after-running time rt_2_new lies between 2 seconds and 120 seconds, for example, and the ventilator speed W_2_new lies between a preadjusted minimum ventilator speed W_min and a preadjusted maximum ventilator speed W_max. If the modeled thermal control parameter T_new lies above the upper threshold value T_s2, then the control unit 30 operates the ventilator 16 in after-running (50*c*) with a ventilator after-running time rt_2_new corresponding to a preadjusted maximum ventilator after-running time rt_max (e.g., 120 seconds) and at a ventilator speed W_2_new corresponding to the preadjusted maximum ventilator speed W_max.

At the end of the ventilator after-running time rt_2_new, the ventilator 16 is switched off (51) by the control unit 30 and the modeled thermal control parameter T_new is stored (52) as a modeled thermal control parameter of a preceding setting process T_old, the current time t_new is stored as timestamp t_old, and the ventilator operating data (ventilator after-running time rt_2_new, ventilator speed W_2_new) are stored in the data storage (31), and the values previously stored therein are overwritten. The newly stored data are used again in a new setting process for modeling the thermal control parameter T_new for controlling the after-running of the ventilator 16 as is indicated by the path 53 shown in dashed lines in FIG. 2.

The heat discharge constant K_s1, the heat supply constant K_s2, and the constant n can be stored separately in the data storage 31 and read into the data processing unit 37 with the other data when reading (see 45*a*) from the data storage 31. However, they can also be anchored in the data processing program and read into the data processing unit 37 with this data processing program.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A method of controlling combustion-operated setting tool having a ventilator (16) for a combustion drive and a control unit (30) for controlling the ventilator, comprising the steps of:

triggering a setting process (44) after a trigger switch signal has been detected (43);

reading out (45*a*) from the data storage (31) the modeled thermal control parameter of a preceding setting process (T-old), the timestamp (t_old), and the ventilator operating data;

modeling (46) a new thermal control parameter (T_new) (46) based at least on the thermal control parameter of the preceding setting process (T_old), the timestamp (t_old), a current time (t_new), the ventilator operating data, and based on heat supply constant (K2) and heat discharge constant (K1); and storing (52) the new modeled thermal control parameter (T_new) of the combustion drive in the data storage (31) as a modeled thermal control parameter (T_new) of a preceding setting process (T_old), storing the current time (t_new) in the data storage (31) as a timestamp (t_old), and storing the ventilator operating data in the data storage (31).

2. A method according to claim 1, wherein an ambient temperature (T_U) determined by a temperature sensor is used for modeling the thermal control parameter (T_new).

3. A method according to claim 1, wherein an after-running time (rt_2_new) of the ventilator (16) is adjusted by the control unit (30) after the modeling of the thermal control parameter (T_new), dependent on the modeled thermal control parameter (T_new) of the combustion drive and on a lower threshold value (T_s1) and upper threshold value (T_s2) which are stored in the data storage (31).

4. A method according to claim 1, wherein a rotational speed (W_2_new) of the ventilator (16) is adjusted by the control unit (30) after modeling the thermal control parameter (T_new) dependent on the modeled thermal control parameter (T_new) of the combustion drive and on a lower threshold value (T_s1) and upper threshold value (T_s2) which are stored in the data storage (31).

5. A method according to claim 1, wherein a rotational speed (W_2_new) and an after-running time (rt_2_new) of the ventilator (16) are adjusted by the control unit (30) after the modeling of the thermal control parameter (T_new) dependent on the modeled thermal control parameter (T_new) of the combustion drive and on a lower threshold value (T_s1) and upper threshold value (T_s2) which are stored in the data storage (31).

6. A method according to claim 1, wherein adjustment of a ventilator after-running time (rt_2_new) by the control unit (30) is first carried out after switching off the signal of switching means (33).

* * * * *

UNITED STATES PATENT AND TRADEMARK OFFICE

CERTIFICATE OF CORRECTION

PATENT NO. : 8,123,095 B2
APPLICATION NO. : 12/218177
DATED : February 28, 2012
INVENTOR(S) : Dittrich It is certified that error appears in the above-identified patent and that said Letters Patent is hereby corrected as shown below:

Title page Item (54) and Col. 1, line 1, Title should read:

COMBUSTION-OPERATED SETTING TOOL

Signed and Sealed this
Fifteenth Day of May, 2012

David J. Kappos

David J. Kappos
*Director of the United States Patent and Trademark Office*